United States Patent [19]

Vance et al.

[11] Patent Number: 4,668,234

[45] Date of Patent: May 26, 1987

[54] AROMATIC POLYAMIDE FIBERS AND PROCESS FOR STABILIZING SUCH FIBERS WITH SURFACTANTS

[75] Inventors: Eric Vance, Wilmington, Del.; Bruce A. Barton, Richmond, Va.

[73] Assignee: E. I. Du Pont de Nemours and Company, Wilmington, Del.

[21] Appl. No.: 871,806

[22] Filed: Jun. 12, 1986

Related U.S. Application Data

[63] Continuation-in-part of Ser. No. 765,724, Aug. 15, 1985, abandoned.

[51] Int. Cl.[4] ..... D06P 5/00; C09B 67/28

[52] U.S. Cl. ..... 8/115.6; 8/115.56; 8/115.65; 8/475; 8/476; 8/491; 8/492; 8/493; 8/538; 8/589; 8/606; 8/650; 8/907; 8/908; 8/925

[58] Field of Search ..... 8/493, 475, 476, 538, 8/650, 115.6, 115.56, 115.65

[56] References Cited

U.S. PATENT DOCUMENTS

| | | | |
|---|---|---|---|
| 3,063,966 | 11/1962 | Kwolek et al. | 528/336 |
| 3,094,511 | 6/1963 | Hill et al. | 524/233 |
| 3,133,138 | 5/1964 | Alexander | 264/235.6 |
| 3,287,324 | 11/1966 | Sweeny | 524/606 |
| 4,059,403 | 11/1977 | Wolf et al. | 8/538 |
| 4,066,396 | 1/1978 | Wolf et al. | 8/489 |
| 4,108,936 | 8/1978 | Wolf et al. | 264/78 |

FOREIGN PATENT DOCUMENTS 1438067 6/1976 United Kingdom .

*Primary Examiner*—A. Lionel Clingman

[57] ABSTRACT

An aromatic polyamide fiber containing a large amount of a surfactant, sufficient to enable it to be dyed a deep shade. The high surfactant level enables the fiber to be stabilized, at low temperatures, against progressive laundry shrinkage.

19 Claims, No Drawings

AROMATIC POLYAMIDE FIBERS AND PROCESS FOR STABILIZING SUCH FIBERS WITH SURFACTANTS

CROSS-REFERENCE TO RELATED APPLICATION

This application is a continuation-in-part of application Ser. No. 765,724, filed Aug. 15, 1985, now abandoned.

BACKGROUND OF THE INVENTION

FIELD OF THE INVENTION

The field of art to which this invention pertains is aromatic polyamide fibers and, more particularly, it is directed to a process for stabilizing such fibers using readily available commercial equipment.

Specifically, such invention is a substantially amorphous, aromatic polyamide fiber containing a surfactant in an amount sufficient to enable the fiber to be dyed a deep shade. More specifically, the fiber must contain from about 5 to 15% of the surfactant, by weight, to be effective. This high surfactant content enables the fiber, in fabric form, to be stabilized against progressive laundry shrinkage, at low temperatures, by use of later routine processing steps, utilizing equipment found in a typical plant, without requiring the use of a carrier.

A typical routine processing step which provides improved stabilization in the surfactant-containing fiber comprises:

heating the amorphous fiber, under pressure, in an aqueous stabilizing bath heated to a low temperature of less than 130° C., and preferably to a temperature of about 127° C., to crystallize it. A dye may be added to the bath and the amorphous fiber may be simultaneously dyed and crystallized in such bath.

Another processing step for stabilizing such fiber comprises:

treating the amorphous fiber, under pressure, with steam heated to a temperature of less than 150° C., and preferably about 145° C., whereby to crystallize such fiber.

The surfactant is imbibed into the fiber while it is water-swollen and prior to drying. A dye may be imbibed into the fiber prior to imbibition of the surfactant. After drying the dyed fiber may be printed with another dye and thereafter treated, under pressure, with steam heated to a temperature of about 145° C. to stabilize it, while simultaneously setting the printed dye.

DESCRIPTION OF THE RELATED ART

Aromatic polyamide fibers are well known to the art. They possess a host of properties, such as high tensile strength, retention of excellent physical properties at high temperatures, flame and heat resistance, good flex life, very high melting points, etc., which make them particularly suited to be formed into fabrics usable as protective clothing for firemen, jet pilots, military personnel or factory workers, and for many other uses.

It further is known that while aromatic polyamide fibers possess many desired properties as manufactured they also require, for given uses, that various steps be taken to improve a property or properties of the fibers to meet a specific end use. As an example, various additives such as dyes, flame retardants, anti-static agents or water repellents, may be incorporated into the fibers, during basic manufacture or in subsequent processing steps to improve their performance levels. Further, the fibers may be treated by various other mechanical or chemical finishing steps or procedures, such as scouring, stretching, shearing or calendering to improve the properties of the fibers.

This invention is particularly directed to aromatic polyamide fibers of a poly(meta-phenylene isophthalamide) polymer, hereinafter referred to as "MPD-I fibers". Such fibers, which are described in greater detail in U.S. Pat. No. 3,287,324 to Sweeny, for example, possess many useful properties.

An important property in fibers of an aromatic polyamide polymer, such as MPD-I, which are to be used, for example, in manufacturing fabrics for clothing is stability or retention of shape or size under normal use conditions. It is well known to the art that untreated MPD-I fibers have a tendency to shrink on exposure to heat. This shrinkage is particularly evident when the clothing is washed; in fact, as a result of repeated washings in hot water MPD-I fibers, as manufactured and without further treatment, shrink to an unacceptable level.

This problem of shrinkage due to repeated washings (e.g., progressive laundry shrinkage) is inherent in untreated MPD-I fibers due to their amorphous nature. Wholly aromatic polymers have a high second order glass transition temperature, above 200° C., and the fibers after manufacture (after spinning and normal processing) are substantially amorphous since none of the typical processing steps are at temperatures high enough to crystallize the fibers. Accordingly, such fibers tend to shrink.

This particular problem is well known to the art and various attempts and approaches have been made to solve it.

A typical solution is shown in U.S. Pat. No. 3,094,511 to Hill et al. which teaches the step of treating amorphous MPD-I fibers with high pressure steam at 100 p.s.i. (170° C.) for ½hour to crystallize such fibers and eliminate or reduce their tendency to shrink. While this high-heat approach is appropriate for some uses, the extreme heat required can be a problem since most commercial autoclaves are only capable of handling a maximum steam pressure of 50 p.s.i. (148° C.), and, additionally, such crystallized fibers are difficult to dye. And it is further known that a steam pressure treatment of 45 to 50 p.s.i., at temperatures under 150° C., taken alone, will not stabilize MPD-I fibers against progressive laundry shrinkage.

Another similar approach of the prior art is seen in U.S. Pat. No. 3,133,138 to Alexander which teaches the step of heating amorphous MPD-I fibers, after drawing, at temperatures between 300° C. and 350° C. for at least 0.2 second while the fibers are under tension in order to crystallize the fibers in an oriented condition. A heated plate is used to crystallize the fibers. Again these crystallized fibers are difficult to dye and the high heat conditions required are not those typically used in routine processing steps in commercial mills.

This being so, a further solution has evolved which permits the use of typical, commercially available equipment to solve the problem of progressive laundry shrinkage. This solution, well known to the art, and widely practiced, uses the step of subjecting the amorphous MPD-I fibers to an aqueous bath containing a carrier, such as acetophenone, heated to a temperature between 121° C. and 132° C. to stabilize the fibers. This heating step crystallizes the fibers and results in acceptable fiber stability. The fibers also may be typically dyed in this same step. The carrier is required to crystallize the fibers; without it, fiber stability cannot be obtained.

While this is an acceptable method of obtaining stability of MPD-I fibers to progressive laundry shrinkage, the carrier is expensive and must be disposed of and this presents a problem of pollution control.

This invention solves these problems of the prior art by imbibing into as-spun, water-swollen aromatic polyamide fibers, before they are dried, a high percentage of a surfactant in an amount sufficient to enable the fibers to be dyed a deep shade. Specifically, the fiber should contain from at least 5 to 15% of the surfactant, by weight.

Surprisingly, these surfactant-containing amorphous fibers can then be dried and later stabilized against progressive laundry shrinkage using commercially available equipment and routine processing steps. For example, the fibers may be brought into contact with an aqueous stabilizing bath heated to a low temperature of less than 130° C., as described previously, to crystallize them, with no carrier required to be present in the bath.

Nor is treatment with a carrier (e.g., acetophenone) required in other typical, fiber stabilizing, processing steps; for example, such fibers may be stabilized by steam treatment in an autoclave operating at routine temperatures below 150° C. (below 50 p.s.i.) with no carrier present.

It is known that treatment at a steam pressure above 60 p.s.i. is required to stabilize MPD-I fibers containing no surfactant. This invention eliminates the need for high pressure autoclaves (above 50 p.s.i.) while still accomplishing desired stability in the fibers, using low temperatures and routine processing steps.

Accordingly, this invention provides an improved process for stabilizing aromatic polyamide fibers using low temperatures (e.g., less than 130° C. when using a stabilizing bath and less than 150° C.. when using steam in an autoclave) without, in either instance, requiring the use of a carrier or solvent to aid crystallization in the stabilizing step. This desired improvement is surprisingly made possible by imbibing into the fibers a surfactant in certain critical amounts. This novel surfactant-containing fiber gives to the art a highly sought capability; that being, ease of stabilization against progressive laundry shrinkage using an on-stream aqueous bath or an autoclave typically found, and frequently used for other purposes, in a given plant, without the need of a carrier.

SUMMARY OF THE INVENTION

Briefly described this invention is an oriented, substantially amorphous, aromatic polyamide fiber containing a surfactant in an amount sufficient to enable the fiber to be dyed a deep shade. Preferably the surfactant level should be at least 5 to 15%, by weight, whereby such fiber may be stabilized against progressive laundry shrinkage by routine processing steps, using conventional equipment.

The aromatic polyamide polymer used in making the fiber has a high second order glass transition temperature of above 200° C. and, preferably, such polymer is poly(metaphenylene isophthalamide).

The surfactants used to render the fiber stabilizable may be cationic, anionic, or neutral.

In accordance with this invention a surfactant is a compound with a molecular structure having one or more hydrophobic groups and one or more hydrophilic groups. The hydrophobic group is an aliphatic hydrocarbon chain of 8 to 22 carbon atons. The hydrophilic group may be a carboxylate, sulfonate, sulfate, phosphate, or quaternary ammonium salt, or a polyoxyethylene chain. Preferred surfactants are hexadecyltrimethylammonium chloride and isopropylammonium dodecylbenzenesulfonate.

In a preferred embodiment the surfactant-containing fiber may be stabilized against progressive laundry shrinkage by a routine processing step of heating the amorphous fiber, under pressure, in an aqueous stabilizing bath heated to a temperature of less than 130° C. and preferably about 127° C. whereby to crystallize such fiber. No carrier is needed in the bath. The aqueous stabilizing bath preferably contains a dye, whereby such amorphous fiber is simultaneously stabilized and dyed in such bath.

In another embodiment the fiber may be stabilized by a different processing step by treating such amorphous fiber, under pressure, with steam heated to a temperature of less than 150° C. and preferably about 145° C. whereby to crystallize it. No carrier is required.

If desired the fibers of this invention may be dyed in an earlier step; for example a vat dye may be imbibed into the fibers prior to imbibing the surfactant and then, after drying, the dyed fibers may be overprinted and thereafter steam treated at low temperatures of less than 150° C. to stabilize the material and set the printed dye.

This invention further is directed to a process for making these fibers which can be stabilized against progressive laundry shrinkage, such process including the steps of extruding a solution of an aromatic polyamide polymer and a solvent through orifices in a spinneret to form amorphous fibers, which amorphous fibers are then moved into contact with an aqueous extraction bath to remove the solvent and during which time such fibers become water-swollen, following which such water-swollen fibers are moved into contact with an aqueous solution containing a surfactant whereby such surfactant is imbibed into such water-swollen fibers, the improvement comprising:

maintaining the water-swollen fibers in contact with the solution containing the surfactant until such surfactant is imbibed into such fibers in a high concentration amount and wherein a dye is imbibed into the amorphous fibers prior to imbibing the surfactant into the fibers.

This invention solves problems existent in the prior art by providing an improved novel aromatic polyamide fiber which contains a critical amount of a surfactant. Such surfactant enables the fiber easily to be stabilized by heating in an aqueous bath normally used for dyeing in a typical plant and heated to a temperature of less than 130° C. or in an autoclave at steam pressures of less than 150° C. Prior to this invention such stabilization could have been accomplished only by adding a carrier to the bath which presented disposal problems to the plant operator or by other methods, such as high pressure autoclaves (over 100 p.s.i.) or high dry heat, using heated plates or rolls. This invention solves these problems and gives to the art a novel fiber easily stabilized by routine processing steps.

DESCRIPTION OF THE PREFERRED EMBODIMENT

This invention is an improved aromatic polyamide fiber and process for making it and for stabilizing it.

More specifically, in the process of this invention, a surfactant is imbibed, in sufficient critical amounts, into an amorphous synthetic fiber or fibers to improve its stability to progressive laundry shrinkage and its dyeability.

The fibers of this invention are prepared from aromatic polyamide polymers such as are disclosed in U.S. Pat. Nos. 3,063,966 to Kwolek, Morgan and Sorenson; 3,094,511 to Hill, Kwolek and Sweeny; and 3,287,324 to Sweeny, for example. These patents, and their teachings, are incorporated by reference into this application.

In the present invention, the term "aromatic polyamide" means a synthetic polymeric material of sufficiently high molecular weight to be fiber-forming, and characterized predominantly by the recurring structural unit

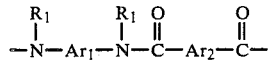

wherein each $R_1$ independently is hydrogen or lower alkyl and wherein $Ar_1$ and $Ar_2$ may be the same or different and may be an unsubstituted divalent aromatic radical or a substituted divalent aromatic radical, the chain-extending bonds of these divalent aromatic radicals being oriented predominately meta to one another and the substituents attached to any aromatic nucleus being one or more or a mixture of lower alkyl, lower alkoxy, halogen, nitro, lower carbalkoxy, or other groups which do not form a polyamide during polymerization. These polymers may be prepared by following the teachings of U.S. Pat. Nos. 3,094,511; 3,287,324 or 3,063,966 mentioned above.

Also comprehended by the term "aromatic polyamide" are copolyamides wherein up to about 15% of $Ar_1$ and/or $Ar_2$ may be replaced with nonaromatic chain-linking divalent organic groups, e.g., hexamethylene, cyclohexyl, etc.

A preferred aromatic polyamide is poly(metaphenylene isophthalamide).

In preparing the basic untreated fibers forming a part of this invention, aromatic polyamides which have been prepared by procedures shown in the above-mentioned patents are combined with various solvents such as dimethylacetamide to form a spinning solution as shown, for example, in U.S. Pat. No. 3,063,966 and the fibers are formed by extruding the spinning solution through orifices in a spinneret. Such fibers may be dry-spun to form a solvent-laden fiber or wet-spun into a coagulating bath to form a water-swollen fiber. In either case, the fibers as spun are substantially amorphous.

"Dry-spinning" refers to a process in which the spinning solution is extruded in the form of thin streams into a heated cell wherein sufficient solvent is caused to evaporate so that the streams are converted into individual filaments which are "dry" enough—even though still containing appreciable quantities of residual solvent—that they are self-supporting. "Wet-spinning" involves a process wherein the polymer spinning solution exits in the form of thin streams which are generated within, or are conducted into, a liquid coagulating bath which causes the polymer to precipitate in the form of self-supporting filaments which may be conducted out of the coagulating bath, and commonly also through subsequent processing steps. Depending on the composition of the coagulating bath, the temperature and time of contact of the filaments with the bath, the filaments may still retain an appreciable quantity of the original polymer solvent at the time they exit the bath.

The just-solidified or just-coagulated filaments or fibers are amorphous at this step of preparation.

As previously stated the fibers whether dry-spun or wet-spun contain a substantial amount of solvent after having been solidified in a dry-spinning evaporation cell or coagulated in a wet-spinning precipitation bath. To remove the solvent such fibers are brought into contact with aqueous extraction bath, as is known in the art. As a result the fibers become "water-swollen" with a water content of 35% or more.

The above-described steps of forming amorphous water-swollen fibers of an aromatic polyamide polymer are known to the art and these fibers are all suitable for being further treated or processed in accordance with this invention to form the novel fibers, also of this invention.

The water-swollen fibers of a preferred embodiment of this invention may be prepared by extruding a solution of poly(meta-phenylene isophthalamide) (MPD-I), e.g., as prepared according to U.S. Pat. No. 3,063,966, in a solvent comprised essentially of dimethylacetamide (DMAc) plus an ionized salt through a multi-hole spinneret into a heated vertical cell, e.g., as described in U.S. Pat. No. 3,360,598. Most of the DMAc is evaporated as the fibers pass through the heated cell, and the filaments emerging from the bottom of the cell are flooded and quenched with an aqueous liquid. These water-swollen fibers are further extracted in and drawn while being passed through a multi-tank apparatus containing heated aqueous baths, e.g., as described in U.S Pat. No. 3,725,523.

In an important step of this invention a surfactant, as described in greater detail hereinafter, is imbibed from a bath into the water-swollen, never dried, fibers in a critical amount to form the novel fiber of this invention. Alternatively, the surfactant may be padded onto, and steamed into, the never-dried fiber.

A suitable process for imbibing such surfactant into the fibers is shown in British Pat. No. 1,438,067 to Moulds and Vance, the teachings of which are incorporated into this application by reference. Essentially this step involves moving the never-dried, water-swollen fibers into contact with an aqueous bath containing the surfactant for a time sufficient to imbibe such surfactant into the fibers in the required amounts.

In an important embodiment of this invention a dye is imbibed from a bath into the water-swollen fibers prior to imbibition of the surfactant. After the imbibing step is completed the fibers are dried at about 140° C., cut into staple fibers, and shipped to a textile processing plant for conversion into yarn and then into fabric. Thereafter the fabric is either dyed or overprinted and stabilized using a critical processing step.

The fibers after drying, whether further processed on line or shipped for further processing, are substantially amorphous.

As has been described, fiber shrinkage is an inherent problem with untreated amorphous MPD-I fibers, and many techniques have been suggested to correct this problem. Most of them require the use of high temperatures; for example, the use of rolls or plates heated to over 300° C., as taught by Alexander or by subjecting the fibers to high (170° C.) temperatures in an autoclave at 100 p.s.i., as taught by Hill et al. Unless these high temperatures are used the fibers will not crystallize to the extent necessary to render them stabilized. For example, it is known that unless the fibers are subjected to a steam pressure temperature of above 60 p.s.i. such fibers have unacceptable shrinkage values when subjected to repetitive progressive laundering.

It further is known that MPD-I fibers may be stabilized in an aqueous dye bath, under pressure, at 121° to 132° C. in the presence of a carrier, such as acetophenone. The carrier must be present in the bath to crystallize the fibers to the extent necessary to render them stabilized. In current commercial practice the fibers are typically dyed with cationic (basic) dyes in this bath.

This invention offers to the art a new method, and a unique step, for solving these problems.

In sum, the touchstone of this invention is the discovery that by imbibing a high percentage of surfactant into never-dried water-swollen MPD-I fibers, as previously described, enables such fibers to be stabilized against progressive laundry shrinkage at low temperatures of less than 130° C. in an aqueous bath or less than 150° C. in steam in an autoclave of the types generally found in a typical plant.

The following examples further illustrate this invention.

EXAMPLE 1

A. Preparation of Never-Dried Filaments of Poly(meta-phenylene isophthalamide) (MPD-I)

Filaments of MPD-I having an inherent viscosity of 1.5 were dry spun from a filtered solution containing 19% MPD-I, 70% dimethylacetamide (DMAc), 9% calcium chloride, and 2% water. On leaving the drying tower the as-spun filaments were given a preliminary wash with water so that they contained about 60% DMAc, 15% calcium chloride, and 100–150% water, based on the weight of dry polymer. The filaments were washed and drawn 4X at 90° C. in a counter-current extraction-draw process in which the calcium chloride determined as chloride content and DMAc content were reduced to about 0.1% and 0.5%, respectively. The wet filaments were gathered together to form a tow, a conventional antistatic finish was applied to the tow, and the tow was crimped in a stuffer box crimper at a temperature of about 80° C. in the presence of steam. The tow was then collected, still water-swollen (containing an amount of water about equal to the weight of the dry tow), in a plastic-lined cardboard box. The individual filaments had a linear density of about 1.55 decitex (1.7 dpf).

B. Imbibition of Surfactant into Never-Dried Filaments of MPD-I

A length of 5427 m (5938 yds) of the water-swollen, never-dried tow prepared in part (A) above, corresponding to a weight of 657 kg (1448 lbs) of dry tow, was piddled into a basket, and the basket was placed in a dye kier. The kier was filled with water at ambient temperature (approximately 25° C. or 77° F.), the weight of water equaling about three times the weight of the tow and 139.5 kg (307 lbs) of a 93 wt. % aqueous solution of isopropylammonium dodecylbenzenesulfonate salt (mixture of isomers), an anionic surfactant, was added. The temperature of the bath was raised to and held at 49° C. (120° F.) for 30 minutes, then raised to the boil and held there for one hour, after which the bath was drained. Air pressure was then applied to the kier to remove excess water, and the wet tow was then piddled back into the plastic-lined cardboard box.

C. Drying the Tow, Forming a Staple Fiber Blend, and Yarn and Fabric Preparation The wet MPD-I tow containing the imbibed anionic surfactant, from part (B) above, was removed from the plastic-lined cardboard box and dried in a conventional drum drier at 140° C. A conventional finish for aramid tow, containing an antistatic agent and a lubricant, was applied to the tow at the drier exit in the amount of 0.38 wt. % finish on the basis of fiber weight.

A staple fiber blend was then prepared by cutting the dried MPD-I tow, together with a dry tow of poly(p-phenylene terephthalamide) (PPD-T) filaments to form staple fibers having a cut length of 5 cm (2 in), the proportion of MPD-I staple fibers to PPD-T staple fibers being 95 to 5 by weight. The PPD-T filaments were commercially available filaments having a modulus of about $6\times10^5$ kg/cm2 (about $9\times10^6$ psi) and a linear density of 1.65 decitex (1.5 dpf), prepared as described in U.S. Pat. No. 3,767,756 to Blades (available as Type 29 Kevlar® aramid fiber from E. I. du Pont de Nemours & Company). A two-ply, 16-tex (37/2 cotton count) spun yarn was then prepared from the staple fiber blend on the cotton system in the conventional manner. A 220 g/m2 (6.5 oz/yd2) plain weave fabric having a construction of 34 ends/cm (87 ends/in) in the warp and 20 ends/cm (50 ends/in) in the filling was then woven in conventional manner from the spun yarn.

The fabric as woven, containing 95 wt. % MPD-I fibers, was analyzed by an extraction technique. It was determined that the MPD-I fibers contained approximately 10.8 wt. % of the anionic surfactant.

D. Dyeing the Fabric

The plain weave fabric from part (C) above was scoured by passing it twice through an open width washer containing an aqueous bath containing 2 g/1 of an ethoxylated alcohol surfactant and 2 g/1 trisodium phosphate, with the bath temperature at 60° C. (140° F.) on the first pass and at 99° C. (210° F.) on the second pass. The scoured fabric was then placed in a pressure beck and water was added and heated to a temperature of 27° C. (80°F.). C. I. Basic Blue 54 dye in an amount equivalent to 4.0 wt. %, based on the weight of the fabric, was pasted with acetic acid and added to the bath. Additional acetic acid was added to adjust the pH of the bath within the range of 4.0 to 5.0. No carrier was added. The temperature of the bath was raised to 88° C. (190° F.) at the rate of about 1.7° C. (3° F.) per minute, the beck was pressurized, and the temperature was then raised at the rate of about 1.7° C. per minute to 127° C. (260° F.) and held there for one hour. After cooling and draining off the bath, the dyed fabric was scoured at 71° C. (160° F.) for 15 minutes with an aqueous bath of 0.5 wt. % of an ethoxylated alcohol surfactant and 0.5 wt. % glacial acetic acid, based on fabric weight The dyed fabric was dryed at 121° C. (250° F.). It was a deep shade of blue.

E. Testing the Dyed Fabric

The dyed fabric, prepared as described in part (D) above, was laundered repeatedly, using a conventional detergent of the anionic surfactant type sold commercially for home use at a 60° C. (140° F.) wash temperature and a 77° C. (170° F.) drying temperature. After 15 cycles of washing and drying the fabric was measured to determine shrinkage. The cumulative shrinkage in warp direction was only 2.2%, and in the fill direction the shrinkage was only 2.0%.

A control fabric containing no imbibed surfactant, but otherwise prepared, dyed, and tested in precisely the same way, was dyed only to a light shade of blue and exhibited 10.8% cumulative shrinkage in the warp direction and 6.4% shrinkage in the fill direction after 15 cycles of washing and drying.

EXAMPLE 2

A. Imbibition of Dye and Surfactant into Never-Dried Filaments of MPD-I

A length of 5427 m (5938 yds) of the water-swollen, never-dried tow prepared in part (A) of Example 1 above, corresponding to a weight of 657 kg (1448 lbs) of dry tow, was piddled into a basket, and the basket was placed in a reversible-flow (inside-out and outside-in) dye kier. The kier was filled with water at ambient temperature, and the water was heated to 37° C. (99° F.) and circulated at that temperature for 5 minutes. Then 6.58 kg (14.50 lb) of a detergent of the ethylene oxide condensate type and 3.29 kg (7.5 lb) of sodium carbonate (soda ash) were added and the resulting scouring solution was heated to 88° C. (190° F.), circulated for 15 minutes at that temperature, and drained, after which the tow in the kier was washed with water at ambient temperature and drained.

The kier was then again filled with water at ambient temperature and 13.6 kg (30 lbs) of a low molecular weight polyamide wetting agent and 3.45 kg (7.6 lbs) of tetrasodium ethylenediaminetetracetate, a sequestering agent for calcium and other metallic ions, were added. The resulting solution was circulated through the tow for 5 minutes, after which 6.55 kg (14.44 lbs) of C.I. (Colour Index) Vat Green 3 dye, 5.11 kg (11.27 lbs) of C.I. Vat Orange 15 dye, and 14.04 kg (30.95 lbs) of a brown dye comprising C.I. Vat Brown 3 dye mixed with a minor amount of C.I. Vat Black 25 dye are slowly added. The resulting dye bath mixture was circulated through the tow for 24 minutes. Then 34.16 kg (75.30 lbs) of caustic flakes (sodium hydroxide) was added and the bath mixture was circulated at ambient temperature for 8 more minutes. Next, 35.4 kg (78 lbs) of a reducing agent, aminoiminomethylsulfinic acid, was added in three portions to reduce the vat dyes to their leuco forms, and the bath was circulated at ambient bath temperature for 8 minutes, after which the temperature was raised to 60° C. (140° F.) and held there for 120 minutes. The temperature was then lowered to 49° C. (120° F.), and the bath was circulated at that temperature for 60 minutes, after which it was circulated in the reverse mode for 20 minutes and drained off.

The kier was then filled with water at ambient temperature and sufficient acetic acid was added to neutralize the bath to a pH of 7.0 or slightly below. To the bath was then added 13.15 kg (29 lbs) of sodium perborate (an oxidizing agent added to oxidize the vat dyes back to their quinone forms), the temperature of the bath was raised to 49° C. (120° F.) and held there for 20 minutes, after which the temperature of the bath was raised to 71° C. (160° F.), 6.57 kg (14.50 lbs) of a detergent of the ethylene oxide condensate type was added, and the temperature of the bath was further raised to 88° C. (190° F.), held there for 24 minutes, and then lowered to 82° C. (180° F.). The tow, green in color owing to the imbibed vat dyes, was then back washed for 5 minutes with ambient temperature water and the kier was then drained, refilled with ambient temperature water, and 122.5 kg (270 lbs) of a 93% wt. % aqueous solution of isopropylammonium dodecylbenzenesulfonate salt (mixture of isomers) was added. The temperature of the bath was raised to and held at 49° C. (120° F.) for 30 minutes, then raised to the boil and held there for one hour, after which the bath was drained. Full vacuum was then applied to the kier to remove excess water, and the wet tow was then piddled back into the plastic-lined cardboard box.

B. Drying the Tow, Forming a Staple Fiber Blend and Yarn and Fabric Preparation The wet MPD-I tow containing imbibed vat dyes and imbibed anionic surfactant from part (A) above was removed from the plastic-lined cardboard box and dried in a conventional drum drier at 140° C. A conventional finish for aramid tow, containing an antistatic agent and a lubricant, was applied to the tow at the drier exit in the amount of 0.38 wt. % finish on the basis of fiber weight.

A staple fiber blend was then prepared by cutting the dried MPD-I tow, together with a dry tow of poly(p-phenylene terephthalamide) (PPD-T) filaments containing a green dye and having a linear density of 1.67 decitex (1.5 dpf), to form staple fibers having a cut length of 5 cm (2 in), the proportion of MPD-I staple fibers to PPD-T staple fibers being 95 to 5 by weight. A two-ply, 16-tex (37/2 cotton count) spun yarn was then prepared from the staple fiber blend on the cotton system in the conventional manner. A 142 g/m$^2$ (4.2 oz/yd$^2$) plain weave fabric having a construction of 29 ends/cm (74 ends/in) in the warp and 20 ends/cm (50 ends/in) in the filling was then woven in conventional manner from the spun yarn.

The fabric as woven, containing 95 wt. % MPD-I fibers, was analyzed by an extraction technique. It was determined that the MPD-I fibers contained approximately 13.9 wt. % of the anionic surfactant.

C. Printing the Fabric

The plain weave fabric from part (B) above was scoured open width on a jig in a bath containing 1 wt. % of an ethoxylated alcohol surfactant and 1 wt. % tetrasodium pyrophosphate, with the bath at 43° C. (110° F.) at the beginning and raising the bath temperature at intervals of about 11° C. (about 20° F.) to 99° C. (210° F.) while running the fabric back and forth through the scour bath in the jig. The final scour temperature of 99° C. was maintained for 20 minutes, after which the scour bath was drained off and the fabric was rinsed at 71° C. (160° F.) for 20 minutes in a bath of water to which 0.5 wt. % (based on fabric weight) of glacial acetic acid was added. The rinsed fabric was vacuum extracted and dried on a tenter frame at 121° C. (250° F.).

The scoured and dried fabric was then subjected to a conventional screen printing, using flat screens. The printing paste compositions comprised the following ingredients:

| | Parts per hundred (p.p.h.) |
|---|---|
| Guar gum thickening agent | 3.00 |
| Sodium nitrate | 2.50 |
| Tallowamine-ethoxylate wetting agent (about 12–20 ethoxy groups) | 0.5 |
| Dyes (amounts totalling X in p.p.h. as specified below) | X |
| Water sufficient to total | 100 parts |

No carrier was added to the printing paste compositions. Three printing paste compositions of green, brown, and black colors were screen printed separately onto the fabric in a pattern showing the green background color from the imbibed vat dyes and the three overprinted colors, using the following dye mixtures in the printing paste composition:

| Dye Component | Amount of dye component added to printing paste (p.p.h.) | | |
|---|---|---|---|
| | Green | Brown | Black |
| C.I. Basic Yellow 21 | 1.20 | 3.00 | 1.10 |
| C.I. Basic Red 29 | 0.25 | 1.00 | 6.00 |
| C.I. Basic Blue 41 | 0.17 | 0.08 | 2.00 |
| Shading component (a basic black dye) | 0.05 | 0.05 | |
| Total amount of dye, X (p.p.h.) | 1.67 | 4.13 | 9.10 |

The screen printed fabric was then steam finished for 5 minutes at 310 kPa (45 psi) gauge pressure (equivalent to 145° C. or 292° F.), rinsed with warm water, and dried. In the finished fabric so printed, each of the overprinted colors was a deep shade.

D. Testing the Printed Fabric

The printed fabric prepared as described in part (C) above was laundered repeatedly, using an institutional formula detergent of the anionic surfactant type at a 60° C. (140° F.) wash temperature and an 82° C. (180° F.) drying temperature. After 15 cycles of washing and drying the fabric was measured to determine shrinkage. The cumulative shrinkage in the warp direction was only 2.0%, and in the fill direction the shrinkage was only 1.0%.

EXAMPLE 3

A. Imbibition of Surfactant into a Tow of Never-Dried Filaments of MPD-I and Drying the Tow.

A quantity of the water-swollen, never-dried tow prepared as described in part (A) of Example 1, equivalent to 14074 g of the dry fiber, was piddled into a basket while adding water at 38° C. (100° F.) to wet out the fiber, and the basket was placed in a package dyeing machine. The dyeing machine was nearly filled with water at 38° C., leaving room for the surfactant solution. A solution of 4222 g of hexadecyltrimethylammonium chloride (50% active ingredient), a cationic surfactant, in an equal weight of water at 38° C. was added to the dyeing machine. The bath was circulated while being maintained at 38° C. for 30 minutes, after which the temperature was increased at the rate of about 1.7° C. (3° F.) to 100° C. (212° F.) and circulated at that temperature for one hour, after which the bath was cooled and drained off. The tow then was dried with hot air at 82°–104° C. (180°–220° F.) in a tray dryer.

B. Forming a Staple Fiber Blend, Preparing Yarn, and Making Fabric.

A staple fiber blend of 95 wt. % fibers from the dried tow and 5 wt. % of PPD-T staple fibers was then formed by cocutting the filaments of the dried tow with PPD-T filaments, as in part (C) of Example 1, to a staple fiber cut length of 5 cm (2 in). A two-ply, 16-tex (37/2 cotton count) spun yarn was then prepared from the staple fiber blend on the cotton system in the conventional manner. A plain weave fabric having a construction of 34 ends/cm (87 ends/in) in the warp and 20.5 ends/cm (52 ends/in) in the filling and a basis weight of about 220 g/m$^2$ (6.5 oz/yd$^2$) was then woven in conventional manner from the spun yarn.

The fabric as woven, containing 95 wt. % MPD-I fibers, was analyzed by an extraction technique. It was determined that the MPD-I fibers contained approximately 7.1 wt. % of the cationic surfactant.

C. Dyeing the Fabric

The plain weave fabric from part (B) above was scoured, using the scouring procedure described at the beginning of part (D) of Example 1. The scoured fabric was then placed in a pressure beck and water was added and heated to 27° C. (80° F.). C.I. Acid Blue 25 dye in an amount equivalent to 4.0 wt. %, based on the weight of the fabric, was pasted with acetic acid and added to the bath. Additional acetic acid was added to adjust the pH of the bath within the range of 4.0 to 5.0. No carrier was added. The temperature of the bath was raised to 88° C. (190° F.) at the rate of about 1.7° C. (3° F.) per minute, the beck was pressurized, and the temperature was then raised at the rate of about 1.7° C. per minute to 102° C. (215° F.) and held there for one hour. The temperature of the bath was then raised at the rate of about 1.7° C. per minute to 127° C. (260° F.) and held there for one hour. After cooling and draining off the bath, the dyed fabric was scoured at 71° C. (160° F.) for 15 minutes with an aqueous bath of 0.5 wt. % of an ethoxylated alcohol surfactant and 0.5 wt. % glacial acetic acid, based on fabric weight. The dyed fabric was dryed at 121° C. (250° F.). It was a deep shade of blue.

D. Testing the Dyed Fabric

The dyed fabric, prepared as described in part (C) above, was laundered repeatedly, using a conventional detergent of the anionic type sold commercially for home use, at a 60° C. (140° F.) wash temperature and a 77° C. (170° F.) drying temperature. After 15 cycles of washing and drying the fabric was measured to determine shrinkage. The cumulative shrinkage in the warp direction was only 3.4%, and in the fill direction the shrinkage was only 1.9%.

EXAMPLE 4

A quantity of 120-kilotex (1,100,000 denier) tow of never-dried MPD-I filaments, prepared as described in Part (A) of Example 1, was passed downwardly into a pool of liquid maintained above the nip of horizontally-mounted steel and rubber rolls and then through the nip under a pressure of 61 kPa (0.6 atmosphere) between the rolls to pad the liquid onto the tow. The liquid was 40 wt. % aqueous solution of polyoxyethylene laurate, a water-soluble neutral surfactant. The tow with the neutral surfactant solution padded on it was then place in a mesh bag, and the bag was suspended in a dye kier wherein it was exposed to steam at about 125° C. (at a pressure of 138 kPa or 20 psi) for 10 minutes, after which the tow was removed from the kier and dried at 100° C. for 2 hours. It was found to contain 7.0 wt. % of the neutral surfactant.

A staple fiber blend of 95 wt. % fibers from the dried tow and 5 wt. % of PPD-T staple fibers was then formed by cocutting the filaments, as in part (C) of Example 1, to a staple fiber cut length of 5 cm (2 in.). A two-ply, 16-tex (37/2 cotton count) spun yarn was then prepared from the staple fiber blend in the conventional manner. A plain weave fabric having a construction of 35 ends/cm (89 ends/in) in the warp and 21.7 ends/cm (55 ends/in) in the filling and a basis weight of about 203 g/m$^2$ (6.0 oz/yd$^2$) was then woven in the conventional manner from the spun yarn.

The plain weave fabric was dyed as in Part (D) of Example 1, using the .same blue dye and following the same procedure, except that the fabric was scoured with plain water (no surfactant or trisodium phosphate added to the scour bath); also, 8.0 wt. % of the dye was used rather than 4.0 wt. %, and no surfactant or acetic acid was used in the final scour. The fabric was dyed a deep shade of reddish blue. The dyed fabric was laundered repeatedly as in Part (E) of Example 1. After 15 cycles of washing and drying the fabric was measured to determine shrinkage. The cumulative shrinkage in the warp direction was 4.3%, and in the fill direction the shrinkage was 2.1%, for a total shrinkage (warp+fill) of 6.4%.

COMPARATIVE EXAMPLE

A quantity of tow of never-dried MPD-I filaments, prepared as described in Part (A) of Example 1, was imibed with an aqueous solution of polyoxyethylene laurate following the procedure generally described in Part (B) of Example 1, except for using the neutral surfactant in place of the anionic surfactant. The tow was then dried and treated with finish and lubricant as described in the first paragraph of Part (C) of Example 1.

The tow so prepared, together with a tow of PPD-T filaments, was then cut to form a staple fiber blend of 95 wt. % fibers from the fried tow and 5 wt. % of PPD-T staple fibers; a spun yarn was prepared; and the yarn was woven to form a plain weave fabric following the procedure generally described in Part (C) of Example 1. The fabric was analyzed and it was determined that the MPD-I fibers contained approximately 4.2 wt. % polyoxyethylene laurate.

The plain weave fabric was dyed as in Part (D) of Example 1, using the same blue dye and following the same procedure. It was dyed a light shade of violet. The dyed fabric was laundered repeatedly as in Part (E) of Example 1. After 15 cycles of washing and drying the fabric was measured to determine shrinkage. The cumulative shrinkage in the warp direction was 6.6%, and in the fill direction the shrinkage was 4.0%, for a total shrinkage (warp+fill) of 10.6%.

EXAMPLE 5

A dyed fabric was prepared as described in Example 3 except that the amount of cationic surfactant in the fibers was 5.0% by weight.

The fabric was laundered repeatedly, as described in Part (D) of Example 3, and after 15 cycles of washing and drying such fabric was measured to determine shrinkage. The cumulative shrinkage in the warp direction was 3.0%, and in the fill direction the shrinkage was 2.7%.

These examples point out the criticality of the high level of surfactant needed in the fibers to bring about desired stabilization results. Specifically, in accordance with this invention it has been found that the fibers must contain at least 5% and up to about 15% of the surfactant, by weight, and, preferably, from 7 to 15%, to attain a combined (warp and fill) acceptable total shrinkage of no more than 7.0% after 15 washings. This criticality has been confirmed by other testing as will be described below.

For example, in one test, a fiber tow of never-dried MPD-I fibers was prepared and various levels of a surfactant were imbibed into the tow by padding the surfactant onto the tow surface and steaming it into the fibers. Specifically, an anionic surfactant, isopropylammonium dodecylbenzenesulfonate, was incorporated into the tow using this process and the tow tested for shrinkage as described in Part (D) of Example 3 with the following results:

After 15 Cycles of Washing and Drying (1) In a tow containing 4.9%, by weight, of the surfactant the cumulative shrinkage in the warp direction was 6.6% and 3.2% in the fill direction for a total shrinkage 9.8%.

(2) In a tow containing 8.5%, by weight, of the surfactant the total shrinkage was 6.0% (3.9 warp % and 2.1% fill).

(3) In a tow containing 12.3%, by weight, of the surfactant, the total shrinkage was 5.0% (3.2% warp and 1.8% fill).

(4) In a tow containing 15.2%, by weight, of the surfactant, the total shrinkage was 7.0% (4.3% warp and 2.7% fill), the upper limit of acceptable total shrinkage.

From these results the criticality of the amount of surfactant added to the fibers to obtain desired shrinage levels is clearly evident.

We claim:

1. An oriented, substantially amorphous, aromatic polyamide fiber containing a surfactant in an amount sufficient to enable the fiber to be dyed a deep shade, and whereby such fiber may be stabilized against progressive laundry shrinkage, in the absence of a carrier, by later routine processing steps, using conventional equipment, wherein the aromatic polyamide is poly(meta-phenylene isophthalamide) and wherein such fiber contains from about 5 to 15%, by weight, of the surfactant.

2. The fiber of claim 1 wherein the aromatic polyamide has a high second order glass transition temperature above 200° C.

3. The fiber of claim 1 wherein the surfactant is neutral.

4. The fiber of claim 1 wherein the surfactant is cationic.

5. The fiber of claim 1 wherein the surfactant is anionic.

6. The fiber of claim 1 wherein the surfactant is hexadecyltrimethylammonium chloride.

7. The fiber of claim 1 wherein the surfactant is isopropylammonium dodecylbenzenesulfonate.

8. The fiber of claim 1 wherein a later routine processing step for stabilizing such fiber comprises:

heating the amorphous fiber under pressure in an aqueous stabilizing bath at a temperature of about 127° C. whereby to crystallize such fiber.

9. The fiber of claim 1 wherein a later routine processing step for stabilizing such fiber comprises:

treating the amorphous fiber with steam at a temperature of about 145° C. whereby to crystallize such fiber.

10. Yarn made from oriented, substantially amorphous, aromatic polyamide fibers containing a surfactant in an amount sufficient to enable the fibers to be dyed a deep shade, which amorphous fibers are crystallized by routine processing steps thereby to stabilize the fibers against progressive laundry shrinkage, wherein the aromatic polyamide is poly(meta-phenylene isophthalamide) and wherein such fibers contain from about 5 to 15%, by weight, of the surfactant.

11. A fabric formed of the yarn of claim 10.

12. An oriented, substantially amorphous, aromatic polyamide fiber containing a surfactant in an amount sufficient to enable the fiber to be dyed a deep shade, and whereby such fiber may be stabilized against progressive laundry srhinkage by a later routine processing step, by heating it in an aqueous dye bath, under pressure, at a low temperature of less than 130° C., using conventional equipment, and wherein such stabilization is obtained, during this step, without requiring the use of a carrier, wherein the aromatic polyamide is poly(meta-phenylene isophthalamide) and wherein such a fiber contains from about 5 to 15%, by weight, of the surfactant.

13. An oriented, substantially amorphous, aromatic polyamide fiber containing a surfactant in an amount sufficient to enable the fiber to be dyed a deep shade, and whereby such fiber may be stabilized against progressive laundry shrinkage by a later routine processing step, by treating it with steam, under pressure, at a low temperature of less than 150° C., using conventional equipment, and wherein such stabilization is obtained, during this step, in the absence of a carrier, wherein the aromatic polyamide is poly(meta-phenylene isophthalamide) and wherein such fiber contains from about 5 to 15%, by weight, of the surfactant.

14. An oriented, substantially amorphous, aromatic polyamide fiber containing a surfactant in an amount sufficient to enable the fiber to be dyed a deep shade, whereby such fiber may be stabilized against progressive laundary shrinkage and dyed by a later routine processing step comprising:

heating the amorphous fiber under pressure in an aqueous stabilizing and dyeing bath at a low temperature of less than 130° C. and wherein such bath contains a dye, and wherein such amorphous fiber is simultaneously stabilized and dyed, wherein the aromatic polyamide is poly(meta-phenylene isophthalamide) and wherein such fiber contains from about 5 to 15%, by weight, of the surfactant.

15. An oriented, substantially amorphous, aromatic polyamide fiber containing a surfactant in an amount sufficient to enable the fiber to be dyed a deep shade, whereby such fiber may be stabilized against progressive laundry shrinkage and dyed by later processing steps comprising:

screen printing the fiber with a dye and thereafter treating the printed fiber, under pressure, with steam at a temperature of less than 150° C.

whereby such printed fiber is simultaneously stabilized and the dye set, wherein the aromatic polyamide is poly(meta-phenylene isophthalamide) and wherein such fiber contains from about 5 to 15%, by weight, of the surfactant.

16. In a process for making synthetic fibers which can be stabilized against progressive laundary shrinkage, which fibers are formed by extruding a solution of an aromatic polyamide polymer and a solvent through orifices in a spinneret to form amorphous fibers, which amorphous fibers are then moved into contact with an aqueous extraction bath to remove the solvent and during which such fibers become water-swollen, following which such water-swollen fibers are moved into contact with an aqueous solution containing a surfactant whereby such surfactant is imbibed into such water-swollen fibers, the improvement comprising:

maintaining the water-swollen fibers in contact with the solution containing the sufactant until such surfactant is imbibed into such fibers in a high concentration amount and wherein a dye is imbibed into such amorphous fibers prior to imbibing the surfactant into the fibers, wherein the aromatic polyamide is poly(meta-phenylene isophthalamide) and wherein such fibers contain from about 5 to 15%, by wieght, of the surfactant.

17. The process of claim 16, in which the dye is a vat dye in lueco form when it is imbibed and is oxidized to the quinone form before the surfactant is imbibed into the fibers.

18. An oriented, substantially amorphous, aromatic polyamide fiber containing from about 5 to 15% of a surfactant, by weight, whereby such fiber may be stabilized against progressive laundry shrinkage, in the absence of a carrier, by later routine processing steps, using conventional equipment.

19. The fiber of claim 18 wherein such fiber contains from about 7 to 15%, by weight, of the surfactant.

* * * * *